US009837011B2

(12) United States Patent
Kim et al.

(10) Patent No.: US 9,837,011 B2
(45) Date of Patent: Dec. 5, 2017

(54) OPTICAL COMPENSATION SYSTEM FOR PERFORMING SMEAR COMPENSATION OF A DISPLAY DEVICE AND OPTICAL COMPENSATION METHOD THEREOF

(71) Applicant: SAMSUNG DISPLAY CO., LTD., Yongin-si, Gyeonggi-do (KR)

(72) Inventors: Inhwan Kim, Yongin-si (KR); Mincheol Kim, Yongin-si (KR); Byunggeun Jun, Yongin-si (KR); Uiyeong Cha, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 35 days.

(21) Appl. No.: 14/973,663

(22) Filed: Dec. 17, 2015

(65) Prior Publication Data

US 2016/0321976 A1 Nov. 3, 2016

(30) Foreign Application Priority Data

Apr. 30, 2015 (KR) ..... 10-2015-0061612

(51) Int. Cl.
*G09G 3/36* (2006.01)
*G09G 3/20* (2006.01)

(52) U.S. Cl.
CPC ..... *G09G 3/2003* (2013.01); *G09G 3/20* (2013.01); *G09G 2320/0242* (2013.01); *G09G 2320/0271* (2013.01); *G09G 2320/0276* (2013.01); *G09G 2320/0693* (2013.01); *G09G 2360/145* (2013.01)

(58) Field of Classification Search
CPC ..... G09G 2360/142; G09G 2320/0271–2320/0276; G09G 2320/0673
See application file for complete search history.

(56) References Cited

U.S. PATENT DOCUMENTS

| | | | | |
|---|---|---|---|---|
| 2001/0015835 | A1 | 8/2001 | Aoki | |
| 2008/0272999 | A1* | 11/2008 | Kurokawa | G09G 3/3406 345/89 |
| 2009/0033646 | A1* | 2/2009 | Liu | G09G 3/3406 345/207 |
| 2010/0007599 | A1* | 1/2010 | Kerofsky | G09G 3/3413 345/102 |
| 2010/0182346 | A1* | 7/2010 | Sano | G09G 3/3413 345/690 |
| 2013/0070007 | A1 | 3/2013 | Park et al. | |

FOREIGN PATENT DOCUMENTS

| | | | |
|---|---|---|---|
| KR | 2001-0100777 | A | 11/2001 |
| KR | 10-2013-0030600 | A | 3/2013 |
| KR | 10-2014-0058095 | A | 5/2014 |
| KR | 10-2014-0082333 | A | 7/2014 |

* cited by examiner

*Primary Examiner* — Sanghyuk Park
(74) *Attorney, Agent, or Firm* — Lewis Roca Rothgerber Christie LLP

(57) ABSTRACT

An optical compensation system includes a display unit including a plurality of pixels, an image pick-up unit for capturing an image displayed on the display unit, and a controller for obtaining brightness data from the image, for performing primary optical compensation on all of the brightness data to generate primary compensation data, and for performing secondary optical compensation such that an output gray scale is less than a maximum gray scale to generate secondary compensation data when the primary compensation data includes at least one output gray scale exceeding a maximum gray scale.

12 Claims, 6 Drawing Sheets

OPTICAL COMPENSATION SYSTEM FOR PERFORMING SMEAR COMPENSATION OF A DISPLAY DEVICE AND OPTICAL COMPENSATION METHOD THEREOF

CROSS-REFERENCE TO RELATED APPLICATION

This application claims priority to, and the benefit of, Korean Patent Application No. 10-2015-0061612, filed on Apr. 30, 2015, in the Korean Intellectual Property Office, the disclosure of which is incorporated herein in its entirety by reference.

BACKGROUND

1. Field

One or more exemplary embodiments relate to an optical compensation system and an optical compensation method thereof.

2. Description of the Related Art

A display device, which is an apparatus capable of providing visual information, is widely used. Examples of the display device include a cathode ray tube display, a liquid crystal display, a field emission display, a plasma display, and an organic light-emitting display, etc.

A problem may occur on an image displayed by a display device due to various reasons, such as the characteristics of the display device itself, unbalance of pixels that occur during a process, and other problems. However, optical compensation may be applied to image data in order to resolve such problems.

SUMMARY

One or more embodiments include an optical compensation system and an optical compensation method thereof.

Additional aspects will be set forth in part in the description that follows and, in part, will be apparent from the description, or may be learned by practice of the presented embodiments.

According to one or more embodiments, an optical compensation system includes a display unit including a plurality of pixels, an image pick-up unit for capturing an image displayed on the display unit, and a controller for obtaining brightness data from the image, for performing primary optical compensation on all of the brightness data to generate primary compensation data, and for performing secondary optical compensation such that an output gray scale is less than a maximum gray scale to generate secondary compensation data when the primary compensation data includes at least one output gray scale exceeding a maximum gray scale.

The controller may be configured to set a secondary optical compensation section including the at least one output gray scale exceeding the maximum gray scale, extract a minimum output gray scale corresponding to a minimum input gray scale of the secondary optical compensation section based on the primary compensation data, extract a maximum output gray scale corresponding to a maximum input gray scale of the secondary optical compensation section based on the primary compensation data, calculate a first compensation ratio to be applied to a first input gray scale by using the first input gray scale included in the secondary optical compensation section, calculate a first output gray scale corresponding to the first input gray scale among the primary compensation data, calculate the minimum input gray scale, calculate the maximum input gray scale, calculate the minimum output gray scale, and calculate the maximum output gray scale.

The first compensation ratio may be inversely proportional to a product of a difference between the first input gray scale and the minimum input gray scale, and a difference between the first input gray scale and the maximum input gray scale, and may be proportional to a product of a difference between the first output gray scale and the minimum output gray scale, and a difference between the first output gray scale and the maximum output gray scale.

The minimum output gray scale may be different from the maximum output gray scale.

The first compensation ratio to be applied to the first input gray scale may be different from a second compensation ratio to be applied to a second input gray scale that is included in the secondary optical compensation section and that may be different from the first input gray scale.

The controller may be configured to apply the first compensation ratio to the first input gray scale to generate a second output gray scale.

The controller may be configured to generate modified image data by using the secondary compensation data in the secondary optical compensation section and by using the primary compensation data in a remainder of sections excluding the secondary optical compensation section with respect to input image data received from outside.

A method of compensating for an optical characteristic of an image provided to a display unit including obtaining brightness data from the image, performing primary optical compensation on the brightness data to generate primary compensation data, and performing secondary optical compensation such that an output gray scale is less than the maximum gray scale to generate secondary compensation data when the primary compensation data includes at least one output gray scale exceeding a maximum gray scale.

Generating the secondary compensation data may include setting a secondary optical compensation section including the at least one output gray scale exceeding the maximum gray scale, setting a minimum input gray scale of the secondary optical compensation section, setting a maximum input gray scale of the secondary optical compensation section, extracting a minimum output gray scale corresponding to the minimum input gray scale of the secondary optical compensation section based on the primary compensation data, extracting a maximum output gray scale corresponding to the maximum input gray scale of the secondary optical compensation section based on the primary compensation data, and calculating a first compensation ratio to be applied to a first input gray scale by using the first input gray scale included in the secondary optical compensation section, a first output gray scale corresponding to the first input gray scale among the primary compensation data, the minimum input gray scale, the maximum input gray scale, the minimum output gray scale, and the maximum output gray scale.

The first compensation ratio may be inversely proportional to a product of a difference between the first input gray scale and the minimum input gray scale, and a difference between the first input gray scale and the maximum input gray scale, and may be proportional to a product of a difference between the first output gray scale and the minimum output gray scale, and a difference between the first output gray scale and the maximum output gray scale.

The minimum output gray scale may be different from the maximum output gray scale.

The first compensation ratio to be applied to the first input gray scale may be different from a second compensation ratio to be applied to a second input gray scale that is included in the secondary optical compensation section and may be different from the first input gray scale.

The method my further include applying the first compensation ratio to the first input gray scale to generate a second output gray scale.

The method may further include receiving input image data from outside, and generating modified image data by using the secondary compensation data in the secondary optical compensation section and the primary compensation data in a remainder of sections excluding the secondary optical compensation section with respect to the input image data.

According to embodiments, an optical compensation system and an optical compensation method that perform smear compensation of a display device may be provided.

BRIEF DESCRIPTION OF THE DRAWINGS

These and/or other aspects will become apparent and more readily appreciated from the following description of exemplary embodiments, taken in conjunction with the accompanying drawings, in which.

DETAILED DESCRIPTION

Figure 1:
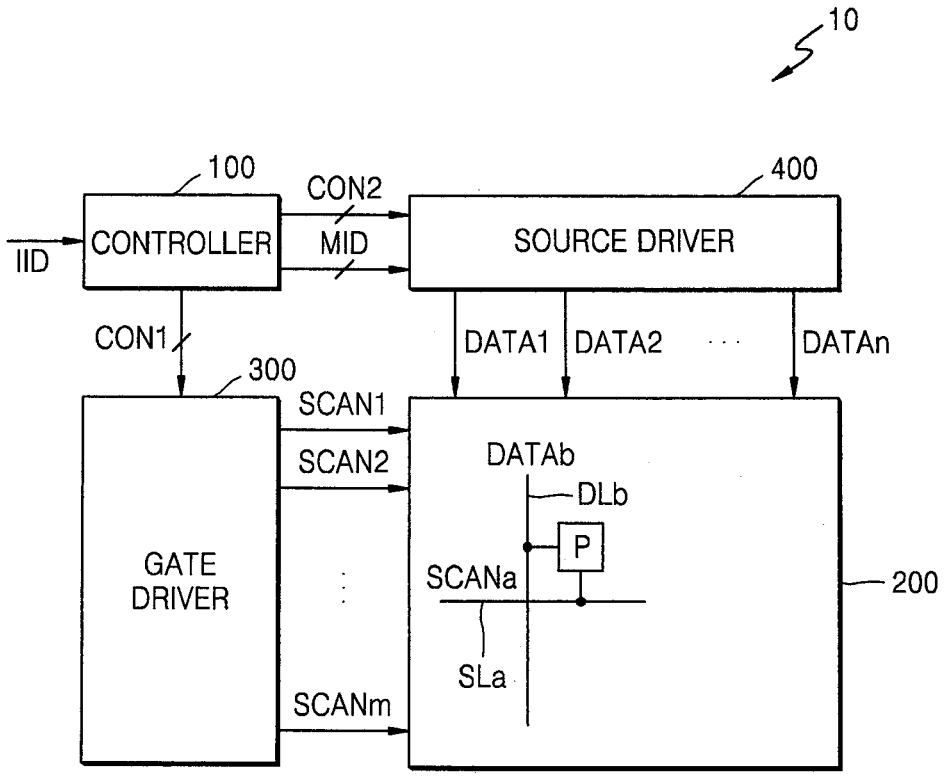
FIG. 1 is a block diagram illustrating a display device according to an exemplary embodiment.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, non-limiting example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as non-limiting examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Referring to FIG. 1 is a block diagram illustrating a display device according to an exemplary embodiment.

Referring to FIG. 1, a display device 10 may include a controller 100, a display unit 200, a gate driver 300, and a source driver 400. The controller 100, the gate driver 300, and/or the source driver 400 may be formed in separate semiconductor chips, respectively, and integrated into one semiconductor chip. Also, the gate driver 300 and/or the source driver 400 may be formed on the same substrate where the display unit 200 is formed. The display device 10 may be a component for displaying an image of an electronic device, such as a smartphone, a tablet personal computer (PC), a laptop PC, a monitor, a television (TV), etc.

A pixel P may be a unit of color expression, capable of displaying various colors. The pixel P may be configured by combination of a color filter and a liquid crystal, combination of a color filter and an organic light-emitting diode (OLED), or an OLED by itself, etc. depending on the type of a display device, and is not limited thereto. The pixel P may include a plurality of sub-pixels. In the present specification, the pixel P may mean a sub-pixel, or may mean one unit pixel including a plurality of sub-pixels.

The display device 10 may receive a plurality of image frames from outside the display device 10. A plurality of image frames may allow one moving picture to be displayed when the plurality of image frames are sequentially displayed. Each of the image frames may include input image data (IID). The IID contains information regarding the brightness of light emitted via a pixel P, and the number of bits of the IID may be determined depending on a step or degree of determined brightness. As a non-limiting example, when a number of steps of brightness of light emitted via a pixel P are 256, the IID may be an 8-bit digital signal. As another non-limiting example, when a darkest gray scale that is displayable via the display unit 200 is a first step, and a brightest gray scale is a $256^{th}$ step, IID corresponding to the first step may be 0 (e.g., 00000000 in binary), and IID corresponding to the $256^{th}$ step may be 255 (e.g., 11111111 in binary).

The controller 100 may be connected to the display unit 200, to the gate driver 300, and to the source driver 400. The controller 100 may generally control the display unit 200, the gate driver 300, and the source driver 400 to operate the display device 10. The controller 100 may receive IID, and may output first control signals CON1 to the gate driver 300. The first control signals CON1 may include a horizontal synchronization signal (HSYNC). The first control signals CON1 may include control signals that the gate driver 300 uses to output scan signals SCAN1 to SCANm that are synchronized with the HSYNC. The controller 100 may output second control signals CON2 to the source driver 400. The second control signals CON2 may include control signals that the source driver 400 uses to synchronize data signals DATA1 to DATAn with scan signals SCAN1 to SCANm, and to output the same.

The controller 100 may output modified image data (MID) to the source driver 400. The MID may be image data generated by correcting IID externally input. The second control signals CON2 may include control signals that the source driver 400 uses to output data signals DATA1 to DATAn corresponding to MID. The MID may include image information used to generate data signals DATA1 to DATAn. The MID may include image data corresponding to respective pixels P on the display unit 200.

The display unit 200 may include a plurality of pixels, a plurality of scan lines that are each connected to a respective row of pixels of the plurality of pixels, and a plurality of data lines that are each connected to a respective column of pixels of the plurality of pixels. As a non-limiting example, as illustrated in FIG. 1, the display unit 200 may include a pixel P included in the plurality of pixels, a first scan line SCANa connected to all pixels in the same row as the pixel P, and a first data line DATAb connected to all pixels in the same column as the pixel P.

The gate driver 300 may output scan signals SCAN1 to SCANm to respective ones of the scan lines. The gate driver 300 may output scan signals SCAN1 to SCANm that are synchronized with a vertical synchronization signal.

The source driver 400 may output data signals DATA1 to DATAn to respective ones of the data lines in synchronization with the scan signals SCAN1 to SCANm. The source driver 400 may output data signals DATA1 to DATAn that are proportional to corresponding IID to the respective data lines.

Figure 2:
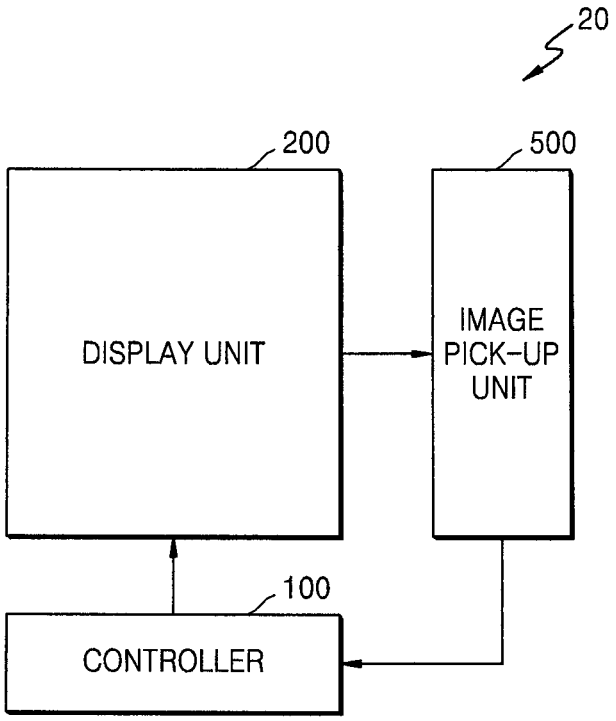
FIG. 2 is a block diagram illustrating an optical compensation system according to an exemplary embodiment.

FIG. 2 refers to a block diagram illustrating an optical compensation system according to an embodiment.

Referring to FIG. 2, an optical compensation system 20 according to an embodiment includes the display device 10, and an image pick-up unit 500 for capturing an image displayed on a display unit 200 of the display device 10. Though FIG. 2 illustrates some elements of the display device 10, the rest of the elements of the display device 10 are not excluded from the optical compensation system 20.

The image pick-up unit 500 captures an image displayed on the display unit 200. The image pick-up unit 500 may include a camera, a scanner, an optical sensor, a spectroscope, etc. The image pick-up unit 500 may be separately installed at an exterior of the display device 10. However, the image pick-up unit 500 is not limited thereto, and the image pick-up unit 500 may be provided at an interior of the display device 10.

The controller 100 obtains brightness data of the display unit 200 from an image captured via the image pick-up unit 500, and generates compensation data based on the brightness data. The brightness data may be an output gray scale corresponding to each input gray scale for each pixel.

The compensation data may refer to data to which a compensation value for each input gray scale has been applied, and may change every pixel.

The controller 100 may select at least two reference input gray scales among all input gray scales, calculate a compensation value for the at least two selected reference input gray scales, and then obtain a compensation value for the rest of the input gray scales by performing interpolation based on the calculated compensation value. Hereinafter, the interpolation and compensation performed by the controller 100 are described in detail with reference to FIGS. 3 to 6.

Figure 3:
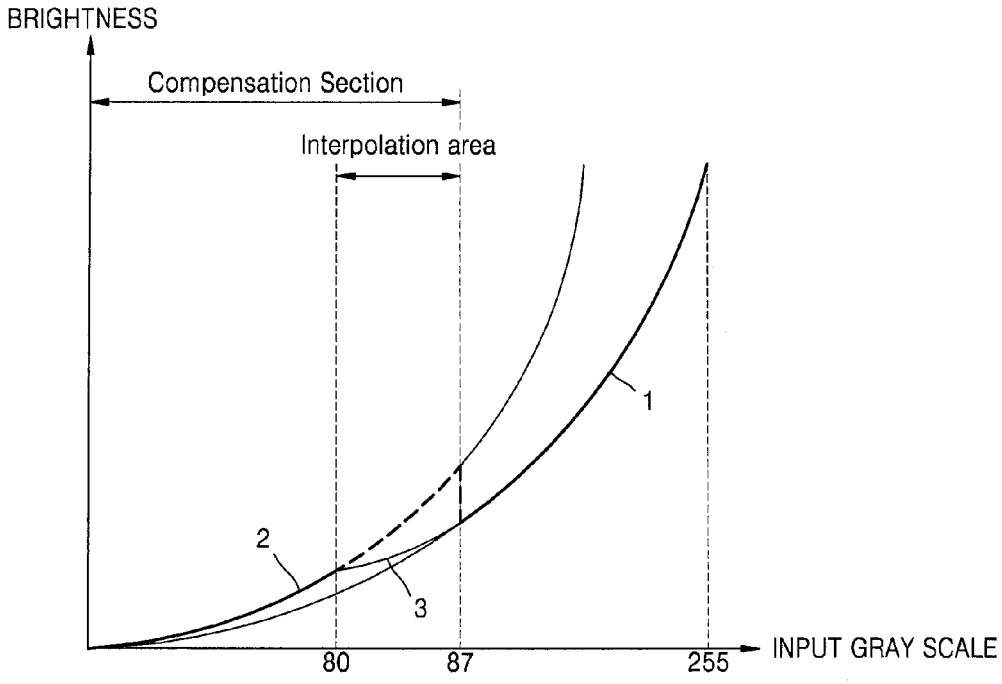
FIG. 3 is a graph for explaining optical compensation results on which interpolation has been performed according to an exemplary embodiment.

FIG. 3 is a graph for explaining optical compensation results on which interpolation has been performed according to an exemplary embodiment.

Referring to FIG. 3, the controller 100 performs interpolation on a portion of brightness data obtained from the display unit 200. As a non-limiting example, the controller 100 may perform compensation on output gray scales corresponding to input gray scales that are relevant to a first step to an $88^{th}$ step among a total of 256 input gray scales. In this embodiment, discontinuity occurs between compensation data 2 of an input gray scale corresponding to the $88^{th}$ step and original data 1 of an input gray scale corresponding to a $89^{th}$ step, and the controller 100 may perform interpolation to provide continuity of brightness.

The controller 100 may set an interpolation section (e.g., a predetermined interpolation section) including an input gray scale where discontinuity has occurred, and may perform interpolation by using a compensation value of an input gray scale included in an interpolation section within the interpolation section. As a non-limiting example, the controller 100 sets an interpolation section including input gray scales corresponding to a range from a $79^{th}$ step to the $88^{th}$ step, and directly uses a compensation value of an input gray scale corresponding to a $79^{th}$ step, that is a minimum/lowest input gray scale of the interpolation section. The controller 100 may gradually reduce a compensation value as an input gray scale increases, and may use only one-eighth of a compensation value of an input gray scale corresponding to the $88^{th}$ step that is a maximum input gray scale of the interpolation section. As described above, the controller 100 may generate interpolation data 3 by using a compensation value for each input gray scale included in the interpolation section.

As a result, the controller 100 may generate modified data by using compensation data 2 of a compensation section, interpolation data 3 of the interpolation section/interpolation area, and the original data 1 of a remainder of the sections.

Figure 4:
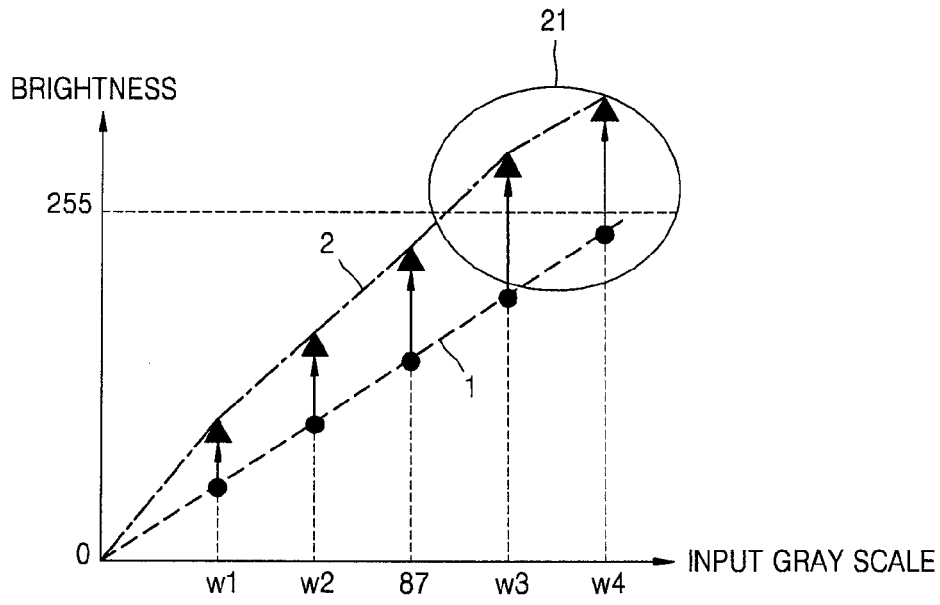
FIG. 4 is a graph for explaining primary optical compensation performance results according to an exemplary embodiment.

FIG. 4 is a graph for explaining primary optical compensation performance results according to an exemplary embodiment.

Referring to FIG. 4, the controller 100 performs compensation on all of brightness data obtained from the display unit 200. As a non-limiting example, the controller 100 may perform compensation on not only output gray scales that correspond to input gray scales that are relevant to a range from the $1^{st}$ step to the $88^{th}$ step, such as a first input gray scale w1 and a second input gray scale w2, but may also perform compensation on output gray scales corresponding to input gray scales that are relevant to steps greater than the $88^{th}$ step, such as a third input gray scale w3 and a fourth input gray scale w4.

The controller 100 may use the same or a different compensation value on an input gray scale basis to generate the compensation data 2. The controller 100 may generate the compensation data 2 for all input gray scales by performing interpolation based on a compensation value for at least two reference input gray scales, and may generate the compensation data 2 by using a compensation value for each of all the input gray scales, and is not limited thereto.

As described above, the controller 100 may determine that the compensation data 2 is modified data. However, when an output gray scale of the compensation data 2 exceeds the $256^{th}$ step that is a maximum gray scale, which is demarcated by the horizontal dashed line in FIG. 4, the controller 100 limits the relevant output gray scale to the $256^{th}$ step. A saturation section 21 refers to a section where an output gray scale converges to the $256^{th}$ step, and a smear may occur on the display unit 200.

Hereinafter, a display device driving method having a wider smear compensation region is described with reference to FIGS. 5 and 6.

Figure 5:
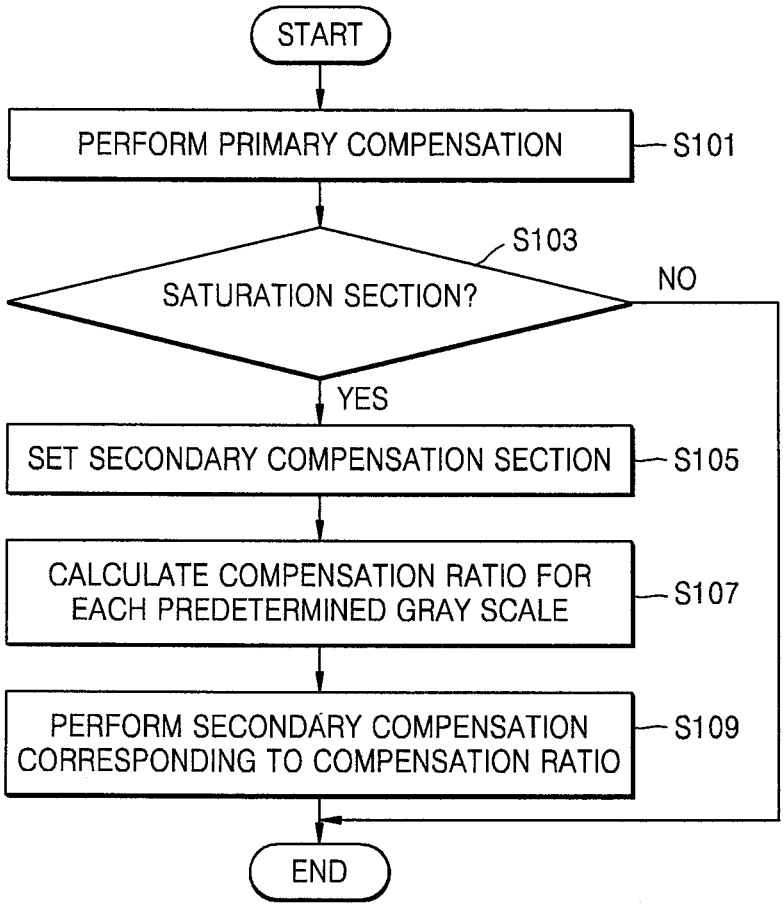
FIG. 5 is a flowchart for explaining an optical compensation method according to an exemplary embodiment.
Figure 6:
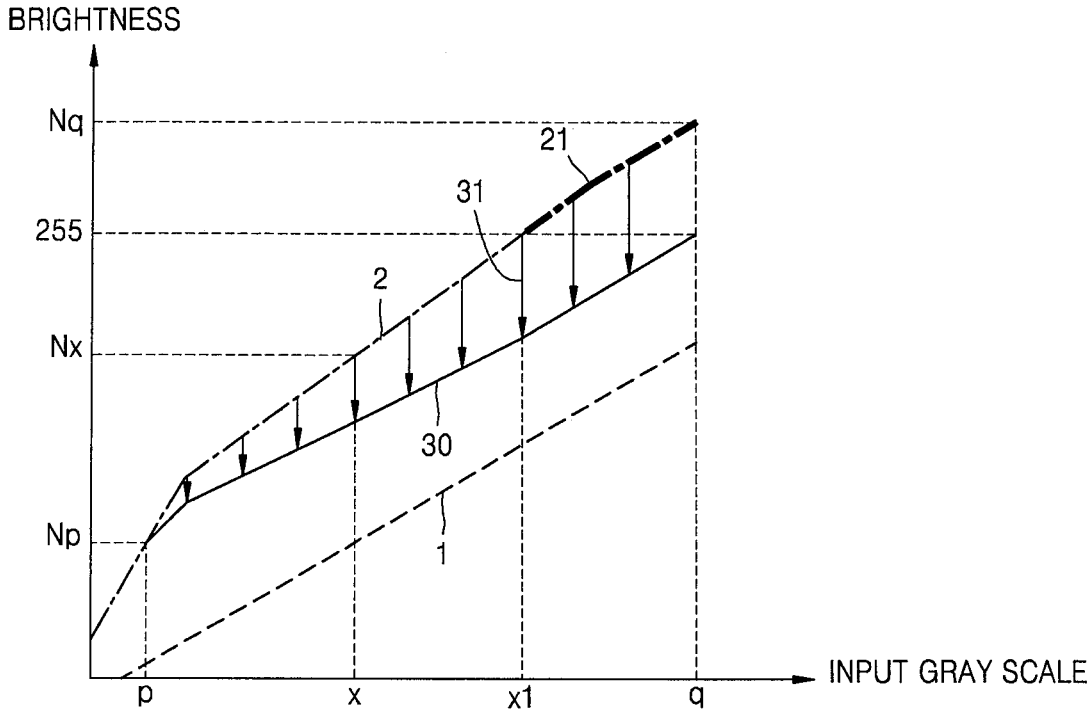
FIG. 6 is a graph for explaining secondary optical compensation performance results according to an exemplary embodiment.

FIG. 5 is a flowchart for explaining an optical compensation method according to an exemplary embodiment, and FIG. 6 is a graph for explaining secondary optical compensation performance results according to an exemplary embodiment.

Referring to FIG. 5, the controller 100 performs primary optical compensation on all of brightness data obtained from the display unit 200 (S101).

Referring to FIG. 6, the controller 100 may generate primary compensation data 2 by applying different compensation values, respectively, to original data 1 for each input grey scale (e.g., each predetermined input gray scale).

Referring to FIG. 5 again, when a saturation section 21 exists in the primary compensation data 2 (S103), the controller 100 sets a secondary optical compensation section (S105), which may include the saturation section 21.

Referring to FIG. 6 again, the controller 100 may set the secondary optical compensation section by setting a minimum input gray scale p and a maximum input gray scale q. The controller 100 may extract a minimum/lowest primary output gray scale Np corresponding to the minimum/lowest input gray scale p, and a maximum/highest primary output gray scale Nq corresponding to a maximum/highest input gray scale q based on the primary compensation data 2.

Referring to FIG. 5 again, the controller 100 calculates a compensation ratio to be applied to an input gray scale included in the secondary optical compensation section (S107). As a non-limiting example, the controller 100 may calculate the compensation ratio to be applied to the input gray scale by using Equation 1.

$$R(x) = 1 - K\frac{(x-p)\cdot(q-x)}{(Nx-Np)\cdot(Nq-Nx)} \qquad \text{Equation 1}$$

In Equation 1, x represents an input gray scale, R(x) represents a compensation ratio of the input gray scale, K is a coefficient, which may be determined in advance and may change depending on a user input, p represents the minimum input gray scale of the secondary optical compensation section, Np represents the minimum primary output gray scale corresponding to the minimum input gray scale, q represents the maximum input gray scale of the secondary optical compensation section, and Nq represents the maximum primary output gray scale corresponding to the maximum input gray scale.

Equation 1 assumes a case where the minimum primary output gray scale Np and the maximum primary output gray scale Nq are different, and x represents the input gray scale between the minimum input gray scale p and the maximum input gray scale q.

The controller 100 may calculate a compensation ratio of each of all input gray scales between the minimum input gray scale p and the maximum input gray scale q, and may calculate a compensation ratio of some input gray scales existing between the minimum input gray scale p and the maximum input gray scale q, although the present embodiment is not limited thereto.

Referring to FIG. 6 again, according to the present embodiment, a compensation ratio 31 for a minimum/lowest input gray scale x1 that is in the saturation section 21 may be set as a maximum compensation ratio.

Referring to FIG. 5 again, the controller 100 performs the secondary optical compensation corresponding to a calculated compensation ratio (S109).

Referring to FIG. 6 again, the controller 100 may generate secondary compensation data 30 by applying compensation ratios for each input gray scale to the secondary optical compensation section of the primary compensation data 2. A second output gray scale may be the same as, or different from, a first output gray scale.

The secondary compensation data 30 may include the second output gray scale corresponding to an input gray scale x. The secondary compensation data 30 may include a minimum secondary output gray scale corresponding to the minimum input gray scale p of the secondary optical compensation section, and may include a maximum secondary output gray scale corresponding to the maximum input gray scale q. The minimum secondary output gray scale may be the same as the minimum primary output gray scale Np, and the maximum secondary output gray scale may be a maximum gray scale, although the present embodiment is not limited thereto.

Subsequently, the controller 100 may effectively perform optical compensation under both a high gray scale and a low gray scale by generating modified data using the secondary compensation data 30 of the secondary optical compensation section and by using the primary compensation data 2 of the rest of sections.

Referring to FIG. 2 again, the controller 100 corrects IID based on the above-described modified data to generate MID.

While one or more exemplary embodiments have been described with reference to the figures, it will be understood by those of ordinary skill in the art that various changes in form and details may be made therein without departing from the spirit and scope as defined by the following claims, and their equivalents.

What is claimed is:

1. An optical compensation system comprising:

a display unit comprising a plurality of pixels;

an image pick-up unit for capturing an image displayed on the display unit; and a controller for obtaining brightness data from the image, for performing primary optical compensation on all of the brightness data to generate primary compensation data, and for performing secondary optical compensation such that an output gray scale is less than a maximum gray scale to generate secondary compensation data when the primary compensation data comprises at least one output gray scale exceeding a maximum gray scale, wherein the controller is configured to:

set a secondary optical compensation section comprising the at least one output gray scale exceeding the maximum gray scale;

extract a minimum output gray scale corresponding to a minimum input gray scale of the secondary optical compensation section based on the primary compensation data;

extract a maximum output gray scale corresponding to a maximum input gray scale of the secondary optical compensation section based on the primary compensation data;

calculate a first compensation ratio to be applied to a first input gray scale by using the first input gray scale included in the secondary optical compensation section;

calculate a first output gray scale corresponding to the first input gray scale among the primary compensation data;

calculate the minimum input gray scale;

calculate the maximum input gray scale;

calculate the minimum output gray scale; and calculate the maximum output gray scale.

2. The optical compensation system of claim 1, wherein the first compensation ratio is:

inversely proportional to a product of a difference between the first input gray scale and the minimum input gray scale, and a difference between the first input gray scale and the maximum input gray scale; and proportional to a product of a difference between the first output gray scale and the minimum output gray scale, and a difference between the first output gray scale and the maximum output gray scale.

3. The optical compensation system of claim 1, wherein the minimum output gray scale is different from the maximum output gray scale.

4. The optical compensation system of claim 1, wherein the first compensation ratio to be applied to the first input gray scale is different from a second compensation ratio to be applied to a second input gray scale that is included in the secondary optical compensation section and that is different from the first input gray scale.

5. The optical compensation system of claim 1, wherein the controller is configured to apply the first compensation ratio to the first input gray scale to generate a second output gray scale.

6. The optical compensation system of claim 1, wherein the controller is configured to generate modified image data by using the secondary compensation data in the secondary optical compensation section and by using the primary compensation data in a remainder of sections excluding the secondary optical compensation section with respect to input image data received from outside.

7. A method of compensating for an optical characteristic of an image provided to a display unit comprising a plurality of pixels, the method comprising:

obtaining brightness data from the image;

performing primary optical compensation on the brightness data to generate primary compensation data; and performing secondary optical compensation such that an output gray scale is less than a maximum gray scale to generate secondary compensation data when the primary compensation data comprises at least one output gray scale exceeding the maximum gray scale, wherein generating the secondary compensation data comprises:

setting a secondary optical compensation section comprising the at least one output gray scale exceeding the maximum gray scale;

setting a minimum input gray scale of the secondary optical compensation section;

setting a maximum input gray scale of the secondary optical compensation section;

extracting a minimum output gray scale corresponding to the minimum input gray scale of the secondary optical compensation section based on the primary compensation data;

extracting a maximum output gray scale corresponding to the maximum input gray scale of the secondary optical compensation section based on the primary compensation data; and calculating a first compensation ratio to be applied to a first input gray scale by using:

the first input gray scale included in the secondary optical compensation section;

a first output gray scale corresponding to the first input gray scale among the primary compensation data;

the minimum input gray scale;

the maximum input gray scale;

the minimum output gray scale; and the maximum output gray scale.

8. The method of claim 7, wherein the first compensation ratio is:

inversely proportional to a product of a difference between the first input gray scale and the minimum input gray scale, and a difference between the first input gray scale and the maximum input gray scale; and proportional to a product of a difference between the first output gray scale and the minimum output gray scale, and a difference between the first output gray scale and the maximum output gray scale.

9. The method of claim 7, wherein the minimum output gray scale is different from the maximum output gray scale.

10. The method of claim 7, wherein the first compensation ratio to be applied to the first input gray scale is different from a second compensation ratio to be applied to a second input gray scale that is included in the secondary optical compensation section and is different from the first input gray scale.

11. The method of claim 7, further comprising applying the first compensation ratio to the first input gray scale to generate a second output gray scale.

12. The method of claim 7, further comprising:

receiving input image data from outside; and generating modified image data by using the secondary compensation data in the secondary optical compensation section and the primary compensation data in a remainder of sections excluding the secondary optical compensation section with respect to the input image data.

* * * * *